US010015615B2

(12) United States Patent
Mitsufuji et al.

(10) Patent No.: US 10,015,615 B2
(45) Date of Patent: Jul. 3, 2018

(54) SOUND FIELD REPRODUCTION APPARATUS AND METHOD, AND PROGRAM

(71) Applicant: Sony Corporation, Tokyo (JP)

(72) Inventors: Yuhki Mitsufuji, Tokyo (JP); Homare Kon, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 15/034,170

(22) PCT Filed: Nov. 11, 2014

(86) PCT No.: PCT/JP2014/079807

§ 371 (c)(1),
(2) Date: May 3, 2016

(87) PCT Pub. No.: WO2015/076149

PCT Pub. Date: May 28, 2015

(65) Prior Publication Data

US 2016/0269848 A1 Sep. 15, 2016

(30) Foreign Application Priority Data

Nov. 19, 2013 (JP) ..... 2013-238791
Feb. 26, 2014 (JP) ..... 2014-034973

(51) Int. Cl.
*H04S 5/02* (2006.01)
*H04S 3/00* (2006.01)
(Continued)

(52) U.S. Cl.
CPC ..... *H04S 7/301* (2013.01); *H04S 7/30* (2013.01); *H04S 7/307* (2013.01); *H04R 1/403* (2013.01);
(Continued)

(58) Field of Classification Search
CPC .. H04S 2420/01; H04S 2400/11; H04S 7/301; H04S 7/303; H04S 2420/13
(Continued)

(56) References Cited

U.S. PATENT DOCUMENTS

2006/0045294 A1* 3/2006 Smyth ..... H04S 7/304 381/309
2012/0259442 A1 10/2012 Jin et al.
(Continued)

FOREIGN PATENT DOCUMENTS

CN 1867208 A 11/2006
CN 101133679 A 2/2008
(Continued)

OTHER PUBLICATIONS

Ise, Boundary Surface Control. Journal of Acoustical Society of Japan. 2011; 67(11):532-8.
(Continued)

*Primary Examiner* — George C Monikang
(74) *Attorney, Agent, or Firm* — Wolf, Greenfield & Sacks, P.C.

(57) ABSTRACT

The present technology relates to a sound field reproduction apparatus and method, and a program, enabled to more accurately reproduce a sound field. A spacial filter application unit obtains a virtual speaker array drive signal of an annular virtual speaker array with a radius larger than a radius of a spherical microphone array, by applying a spacial filter to a spacial frequency spectrum of a sound collection signal obtained by having the spherical microphone array collect sounds. An inverse filter generation unit obtains an inverse filter based on a transfer function from a real speaker array up to the virtual speaker array. An inverse filter application unit applies the inverse filter to a time frequency spectrum of the virtual speaker array drive signal, and
(Continued)

obtains a real speaker array drive signal of the real speaker array. The present technology can be applied to a sound field reproduction device.

4 Claims, 9 Drawing Sheets

(51) Int. Cl.

| | |
|---|---|
| ***H04R 5/02*** | (2006.01) |
| ***H04S 7/00*** | (2006.01) |
| *H04R 1/40* | (2006.01) |
| *H04R 5/027* | (2006.01) |

(52) U.S. Cl.
CPC ..... *H04R 1/406* (2013.01); *H04R 5/027* (2013.01); *H04S 2400/15* (2013.01); *H04S 2420/01* (2013.01); *H04S 2420/07* (2013.01)

(58) Field of Classification Search
USPC ..... 381/17–19, 303, 310
See application file for complete search history.

(56) References Cited

U.S. PATENT DOCUMENTS

| | | | | |
|---|---|---|---|---|
| 2013/0148812 | A1* | 6/2013 | Corteel | H04S 7/30 381/17 |
| 2013/0236039 | A1 | 9/2013 | Jax et al. | |
| 2014/0056430 | A1* | 2/2014 | Choi | H04S 5/00 381/17 |

FOREIGN PATENT DOCUMENTS

| | | | |
|---|---|---|---|
| CN | 103250207 | A | 8/2013 |
| JP | 2012-109643 | A | 6/2012 |
| JP | 2013-507796 | A | 3/2013 |
| JP | 2013-137908 | A | 7/2013 |
| JP | 2013-172236 | A | 9/2013 |
| JP | 2014-165901 | A | 9/2014 |
| WO | WO 2012/152588 | A1 | 11/2012 |

OTHER PUBLICATIONS

Li et al., Capture and Recreation of Higher Order 3D Sound Fields Via Reciprocity. Proceedings of ICAD 04-Tenth Meeting of the International Conference on Auditory Display. Sydney, Australia, Jul. 20-28, 2004. 8 pages.

Bertet et al., 3D Sound Field Recording with Higher Order Ambisonics—Objective Measurements and Validation of Spherical Microphone, Audio Engineering Society, Convention Paper 6857, 120$^{th}$ Convention, May 20-23, 2006, Paris, France, 24 pages.

Boehm et al., Decoding for 3D, Audio Engineering Society, Convention Paper 8426, 130$^{th}$ Convention, May 13-16, 2011, London, UK, 16 pages.

Rafaely B., Analysis and Design of Spherical Microphone Arrays, IEEE Transactions on Speech and Audio Processing, Jan. 2005, vol. 13, No. 1, pp. 135-143.

Written Opinion and English translation thereof dated Dec. 9, 2014 in connection with International Application No. PCT/JP2014/079807.

International Preliminary Report on Patentability and English translation thereof dated Jun. 2, 2016 in connection with International Application No. PCT/JP2014/079807.

* cited by examiner

SOUND FIELD REPRODUCTION APPARATUS AND METHOD, AND PROGRAM

TECHNICAL FIELD

The present technology relates to a sound field reproduction apparatus and method, and a program, and in particular, relates to a sound field reproduction apparatus and method, and a program, enabled to more accurately reproduce a sound field.

BACKGROUND ART

In related art, technology has been proposed that reproduces a sound field similar to that of a real space in a reproduction space, by using a signal collected by a spherical or annular microphone array in a real space.

For example, as such technology, enabling sound collection by a compact spherical microphone array and regeneration by a speaker array has been proposed (for example, refer to Non-Patent Literature 1).

Further, for example, enabling regeneration by a speaker array with an arbitrary array shape, and enabling transfer functions from speakers up to microphones to be collected beforehand, and differences of the characteristics of individual speakers to be absorbed by generating an inverse filter, has also been proposed (for example, refer to Non-Patent Literature 2).

CITATION LIST

Non-Patent Literature

Non-Patent Literature 1: Zhiyun Li et al, "Capture and Recreation of Higher Order 3D Sound Fields via Reciprocity," Proceedings of ICAD 04-Tenth Meeting of the International Conference on Auditory Display, Sydney, 2004

Non-Patent Literature 2: Shiro Ise, "Boundary Sound Field Control", Journal of the Acoustical Society of Japan, Vol. 67. No. 11, 2011

SUMMARY OF INVENTION

Technical Problem

However, in the technology disclosed in Non-Patent Literature 1, while sound collection by a compact spherical microphone array and regeneration by a speaker array are possible, the shape of the speaker array is spherical or annular in order for strict sound field reproduction, and restrictions are sought after such as it being necessary for the speakers to have an arrangement of equal densities.

For example, as shown on the left side of FIG. 1, each of the speakers constituting a speaker array SPA11 are annularly arranged, and within the figure, strict sound field reproduction is possible, in the case where becoming an arrangement where each of the speakers have equal densities (equal angles in the figure for simplicity), with respect to a reference point represented by a dotted line. In this example, for two arbitrary speakers that are mutually adjacent, an angle, formed by a straight line connecting one of the speakers and the reference point and a straight line connecting the other speaker and the reference point, becomes a constant angle.

In contrast to this, in the case of a speaker array SPA12 constituted from speakers aligned at equal intervals in a rectangular shape such as shown on the right side, within the figure, the speakers do not have equal densities from a reference point represented by a dotted line, within the figure, and so sound field reproduction is not able to be strictly performed. In this example, an angle, formed by a straight line connecting one of two speakers that are mutually adjacent and the reference point and a straight line connecting the other speaker and the reference point, becomes a different angle for each group of two adjacent speakers.

Further, since a drive signal is generated that assumes an ideal speaker array, such as emitting a mono-pole sound source, a sound field of a real space is not able to be accurately reproduced due to the influence of the characteristics of actual speakers.

In addition, in the technology disclosed in Non-Patent Literature 2, if it is possible to perform regeneration with an arbitrary array shape, and collect transfer functions from speakers up to microphones beforehand and generate an inverse filter, it will be possible to absorb differences of the characteristics of individual speakers. On the other hand, in the case where a transfer function group from each of the speakers to each of the microphones collected beforehand maintains similar characteristics, it will be difficult to obtain a stable inverse filter, for generating a drive signal from the transfer functions.

In the case where microphones constituting a spherical microphone array MKA11 are close to one another, such as an example using the spherical microphone array MKA11, in particular, shown on the right side of FIG. 2, the distances from a specific speaker of a speaker array SPA21 constituted from speakers aligned at equal intervals in a rectangular shape to all of the microphones will become approximately equal distances. Accordingly, it will be difficult to obtain a stable solution of an inverse filter.

Note that, on the left side, within FIG. 2, an example is shown where the distances from the speakers of the speaker array SPA21 to each of the microphones constituting a spherical microphone array MKA21 are not equal distances, and the variations of transfer functions become large. In this example, since the distances from the speakers of the speaker array SPA21 to each of the microphones are different, a stable solution of an inverse filter can be obtained. However, is it not realistic to make the radius of the spherical microphone array MKA21 large to the extent where a stable solution of an inverse filter is able to be obtained.

The present technology is performed by considering such a situation, and can more accurately reproduce a sound field.

Solution to Problem

According to an aspect of the present technology, a sound field reproduction apparatus includes: a first drive signal generation unit configured to convert a sound collection signal obtained by having a spherical or annular microphone array collect sounds into a drive signal of a virtual speaker array having a second radius larger than a first radius of the microphone array; and a second drive signal generation unit configured to convert the drive signal of the virtual speaker array into a drive signal of a real speaker array arranged inside or outside a space surrounded by the virtual speaker array.

The first drive signal generation unit may convert the sound collection signal into the drive signal of the virtual speaker array by applying a filter process using a spacial filter to a spacial frequency spectrum obtained from the sound collection signal.

The sound field reproduction apparatus may further include: a spacial frequency analysis unit configured to convert a time frequency spectrum obtained from the sound collection signal into the spacial frequency spectrum.

The second drive signal generation unit may convert the drive signal of the virtual speaker array into the drive signal of the real speaker array by applying a filter process to the drive signal of the virtual speaker array by using an inverse filter based on a transfer function from the real speaker array up to the virtual speaker array.

The virtual speaker array may be a spherical or annular speaker array.

A sound field reproduction method or program according to an aspect of the present technology includes: a first drive signal generation step of converting a sound collection signal obtained by having a spherical or annular microphone array collect sounds into a drive signal of a virtual speaker array having a second radius larger than a first radius of the microphone array; and a second drive signal generation step of converting the drive signal of the virtual speaker array into a drive signal of a real speaker array arranged inside or outside a space surrounded by the virtual speaker array.

According to an aspect of the present technology, a sound collection signal obtained by having a spherical or annular microphone array collect sounds is converted into a drive signal of a virtual speaker array having a second radius larger than a first radius of the microphone array, and the drive signal of the virtual speaker array is converted into a drive signal of a real speaker array arranged inside or outside a space surrounded by the virtual speaker array.

Advantageous Effects of Invention

According to an aspect of the present technology, a sound field can be more accurately reproduced.

Note that, the effect described here is not necessarily limited, and may be any of the effects described within the present description.

DESCRIPTION OF EMBODIMENTS

Hereinafter, embodiments to which the present technology is applied will be described by referring to the figures.

First Embodiment

The Present Technology

In the present technology, a drive signal of a real speaker array is generated, so that a sound field the same as that of a real space is reproduced in a reproduction space, by using a signal collected by a spherical or annular microphone array in a real space. In this case, it is assumed that the microphone array is sufficiently small and compact.

Further, a spherical or annular virtual speaker array is arranged inside or outside the real speaker array. Also, a virtual speaker array drive signal is generated from a microphone array sound collection signal, by a first signal process. Further, a real speaker array drive signal is generated from the virtual speaker array drive signal, by a second signal process.

Figure 3:
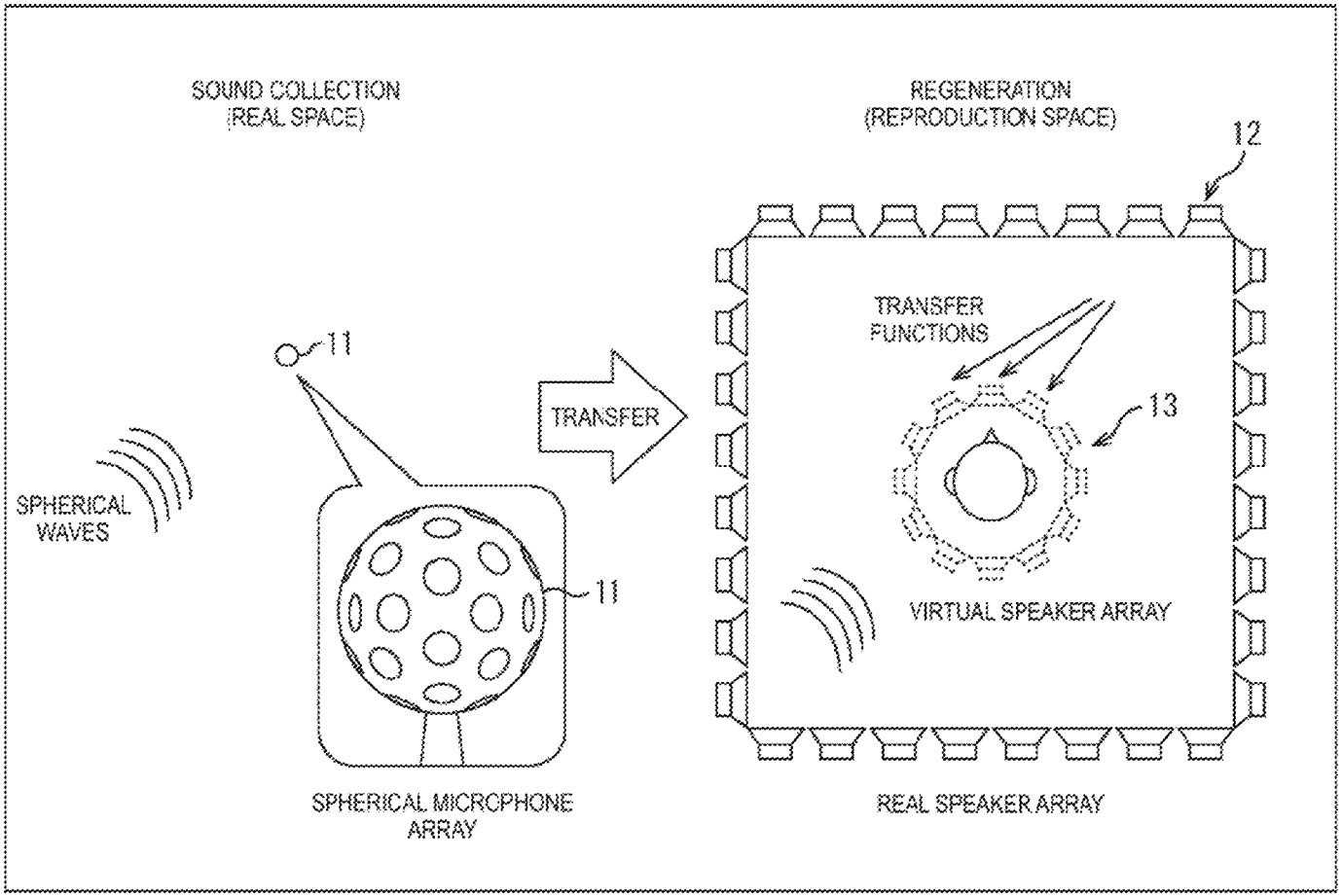
FIG. 3 is a figure that describes sound field reproduction of the present technology.

For example, in the example shown in FIG. 3, spherical waves of a real space are collected by a spherical microphone array 11, and a sound field of the real space is reproduced, by supplying, to a real speaker array 12 arranged in a rectangular shape in a reproduction space, a drive signal obtained from a drive signal of a virtual speaker array 13 arranged inside this.

In FIG. 3, the spherical microphone array 11 is constituted from a plurality of microphones (microphone sensors), and each of the microphones are arranged on the surface of a sphere centered on a prescribed reference point. Hereinafter, the center of the sphere where the speakers constituting the spherical microphone array 11 are arranged will be called a center of the spherical microphone array 11, and the radius of this sphere will be called a radius of the spherical microphone array 11, or a sensor radius.

Further, the real speaker array 12 is constituted from a plurality of speakers, and these speakers are arranged by aligning in a rectangular shape. In this example, the speakers constituting the real speaker array 12 are aligned on a horizontal surface so as to surround a user at a prescribed reference point.

Note that, the arrangement of the speakers constituting the real speaker array 12 is not limited to the example shown in FIG. 3, and each of the speakers may be arranged so as to surround a prescribed reference point. Therefore, for example, each of the speakers constituting the real speaker array may be installed on the ceiling or a wall of a room.

Figure 1:
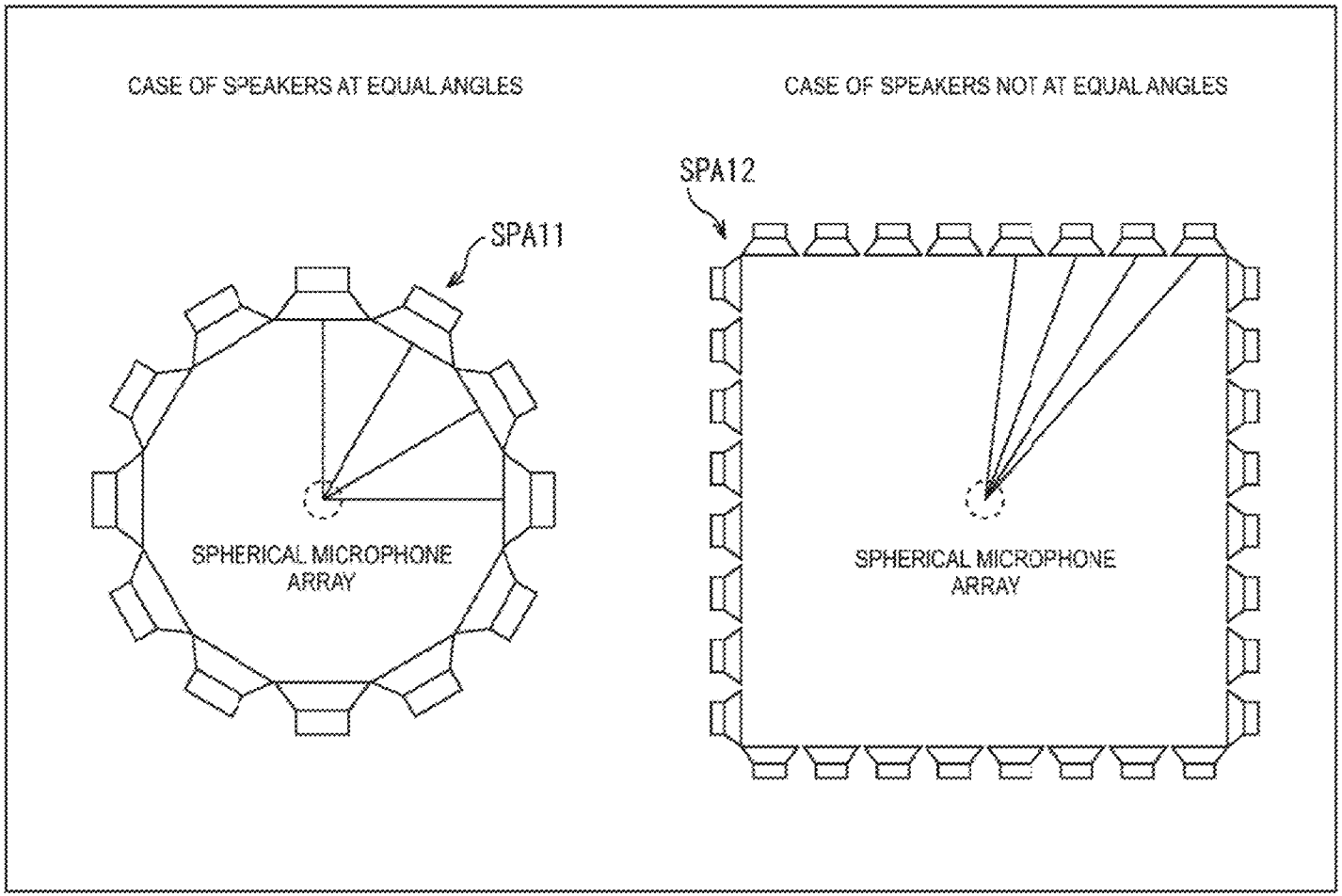
FIG. 1 is a figure that describes sound field reproduction of the related art.
Figure 2:
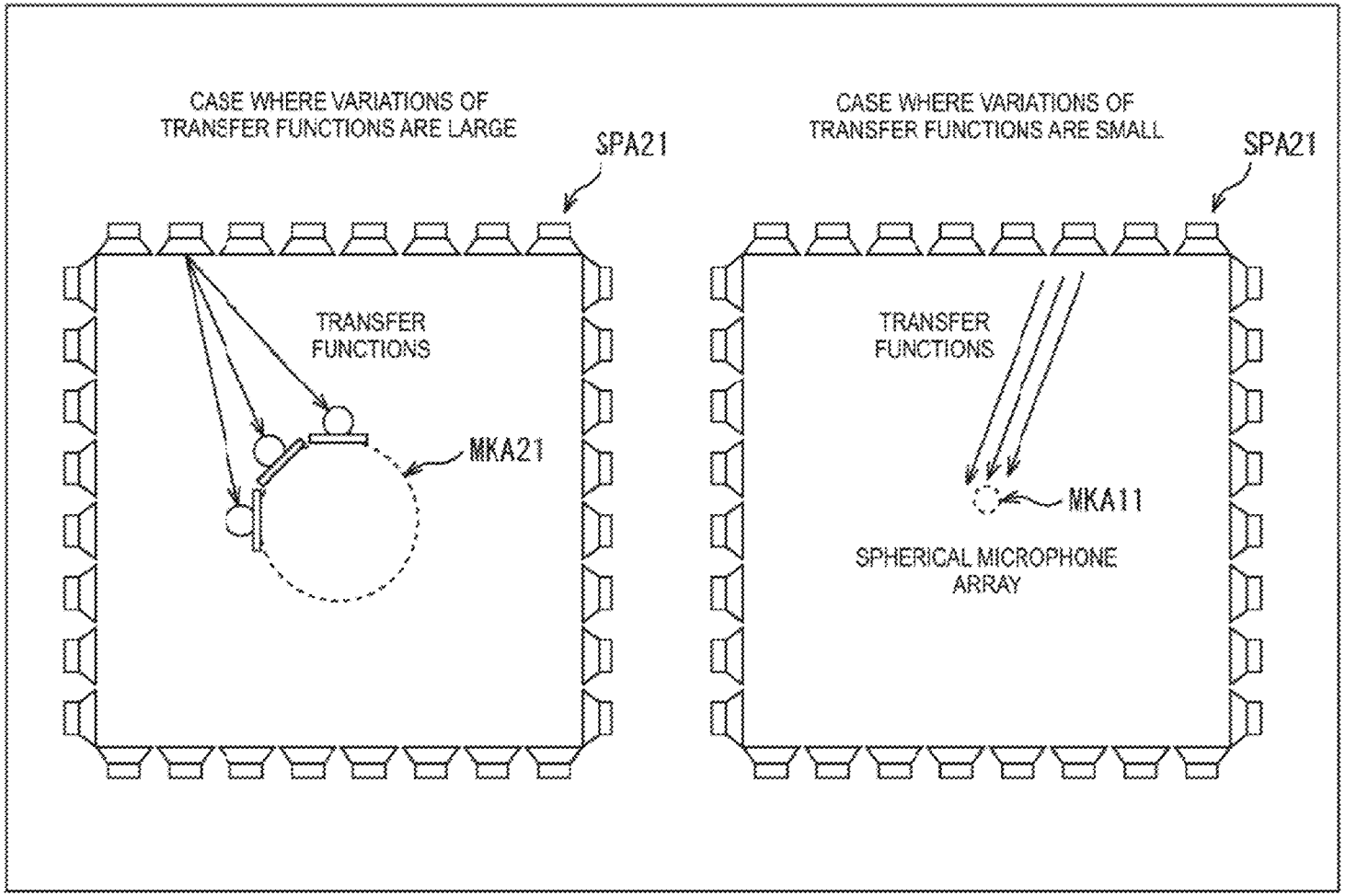
FIG. 2 is a figure that describes sound field reproduction of the related art.

In addition, in this example, the virtual speaker array 13 obtained by aligning a plurality of virtual speakers is arranged inside the real speaker array 12. That is, the real speaker array 12 is arranged outside a space surrounded by the speakers constituting the virtual speaker array 13. In this example, each of the speakers constituting the virtual speaker array 13 are circularly (annularly) aligned centered on a prescribed reference point, and these speakers are arranged so as to be aligned with equal densities with respect to the reference point, similar to the speaker array SPA11 shown in FIG. 1.

Hereinafter, the center of a circle where the speakers constituting the virtual speaker array 13 are arranged will be called a center of the virtual speaker array 13, and the radius of this circle will be called a radius of the virtual speaker array 13.

Here, in a reproduction space, it may be necessary for a center position of the virtual speaker array 13, that is, the reference point, to be set to the same position as a center position (reference point) of the spherical microphone array 11 assumed to be in the reproduction space. Note that, the center position of the virtual speaker array 13 and the center position of the real speaker array 12 may not necessarily be at the same position.

In the present technology, a virtual speaker array drive signal for reproducing a sound field of a real space are generated by the virtual speaker array 13, from a sound collection signal obtained first by the spherical microphone array 11. Since the virtual speaker array 13 is circular (annular), and each of the speakers are arranged with equal densities (equal intervals) when viewed from this center, a virtual speaker array drive signal is generated that can more accurately reproduce a sound field of a real space.

In addition, a real speaker array drive signal for reproducing a sound field of a real space are generated by the real speaker array 12, from such an obtained virtual speaker array drive signal.

At this time, a real speaker array drive signal is generated by using an inverse filter obtained from transfer functions from each of the speakers of the real speaker array 12 up to each of the speakers of the virtual speaker array 13. Therefore, the shape of the real speaker array 12 can be set to an arbitrary shape.

In this way, in the present technology, a sound field can be accurately reproduced, regardless of the shape of the real speaker array 12, by generating a virtual speaker array drive signal of the spherical or annular virtual speaker array 13, once from a sound collection signal, and additionally converting this virtual speaker array drive signal into a real speaker array drive signal.

Figure 4:
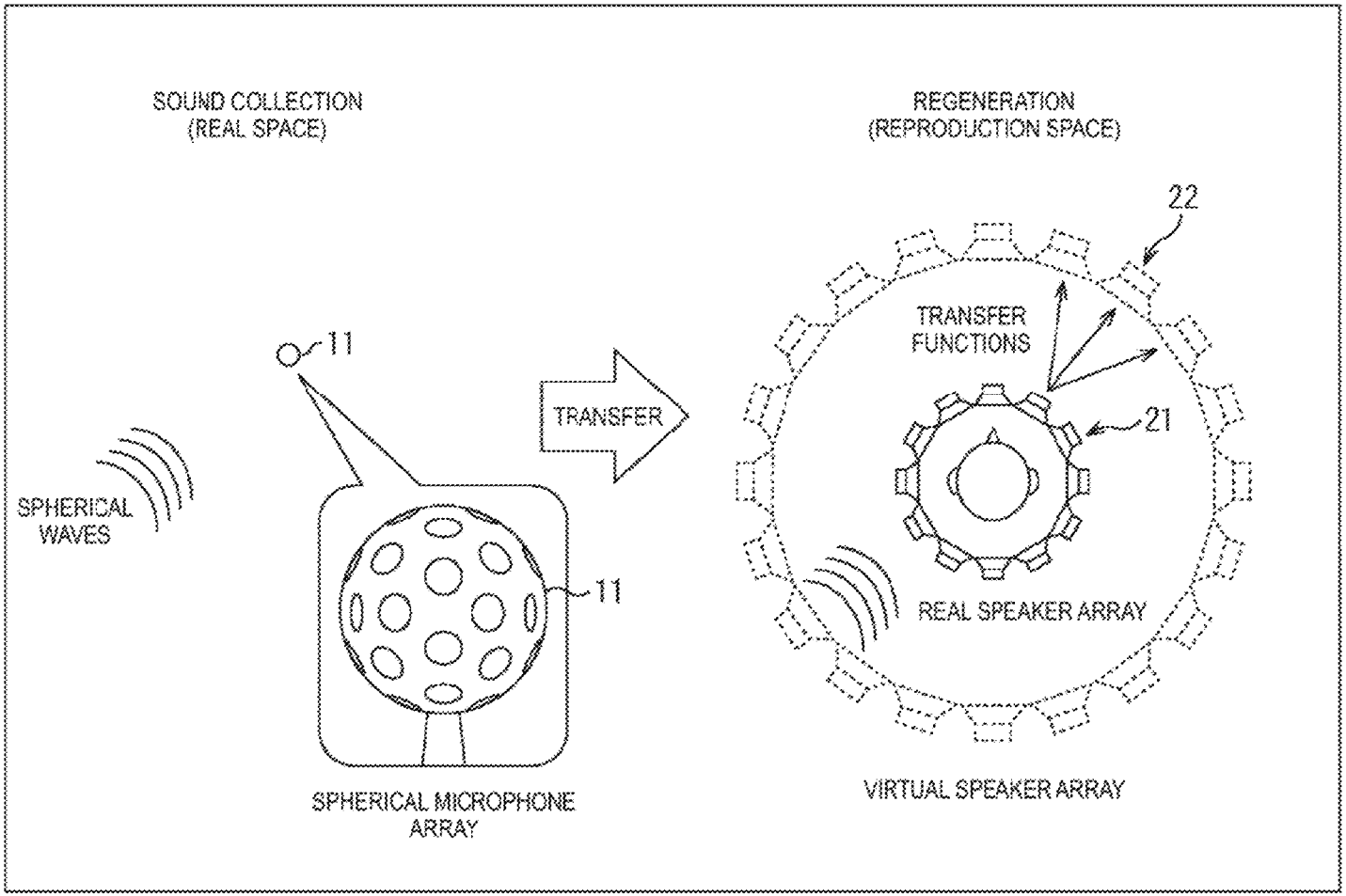
FIG. 4 is a figure that describes another example of sound field reproduction of the present technology.

Note that, hereinafter, while the case where the virtual speaker array 13 is arranged inside the real speaker array 12 such as shown in FIG. 3 will be described as an example, a real speaker array 21 such as shown in FIG. 4, for example, may be arranged inside a space surrounded by the speakers constituting a virtual speaker array 22. Note that, the same reference numerals are attached in FIG. 4 to the portions corresponding to the case in FIG. 3, and a description of these will be arbitrarily omitted.

In the example of FIG. 4, each of the speakers constituting the real speaker array 21 are arranged on a circle centered on a prescribed reference point. Further, each of the speakers constituting the virtual speaker array 22 are also arranged at equal intervals on a circle centered on the prescribed reference point.

Therefore, in this example, a virtual speaker array drive signal for reproducing a sound field by the virtual speaker array 22 is generated from a sound collection signal, by the first signal process described above. Further, a real speaker array drive signal for reproducing a sound field by the real speaker array 21 constituted from speakers arranged on a circle with a radius smaller than the radius of the virtual speaker array 22 is generated from the virtual speaker array drive signal, by the second signal process.

For example, a speaker array installed on a wall of a room in a house or the like will be assumed as the real speaker array 12 shown in FIG. 3, and a portable speaker array surrounding the head of a user will be assumed as the real speaker array 21 shown in FIG. 4. In these examples shown in FIG. 3 and FIG. 4, the virtual speaker array drive signal obtained by the above described first signal process can be commonly used.

According to the present technology, a sound field reproduction apparatus can be implemented, for example, such as including a sound collection unit that preserves a sound field by a spherical or annular microphone array with a diameter to the extent of a user's head, in a real space, including a first drive signal generation unit that generates a drive signal to a spherical or annular virtual speaker array with a diameter larger than that of the above described microphone array, so as to become a sound field the same as that of a real space, in a reproduction space, and including a second drive signal generation unit that signal converts the above drive signal to an arbitrary shaped real speaker array arranged inside or outside a space surrounding the above virtual speaker array.

Also, according to the present technology, the following effect (1) through to effect (3) can be obtained.

Effect (1)

It is possible for a signal collected by a compact spherical or annular microphone array to be sound field reproduced from an arbitrary array shape.

Effect (2)

It is possible for a drive signal absorbing the variations of speaker characteristics and the reflection characteristics of a reproduction space to be generated, by using recorded transfer functions, at the time of a calculation of an inverse filter.

Effect (3)

It is possible for an inverse filter of transfer functions to have a stable solution, by widening the radius of the spherical or annular virtual speaker array.

Configuration Example of the Sound Field Reproduction Device

Next, a specific embodiment to which the present technology is applied will be described, by setting the case where the present technology is applied to a sound field reproduction device as an example.

Figure 5:
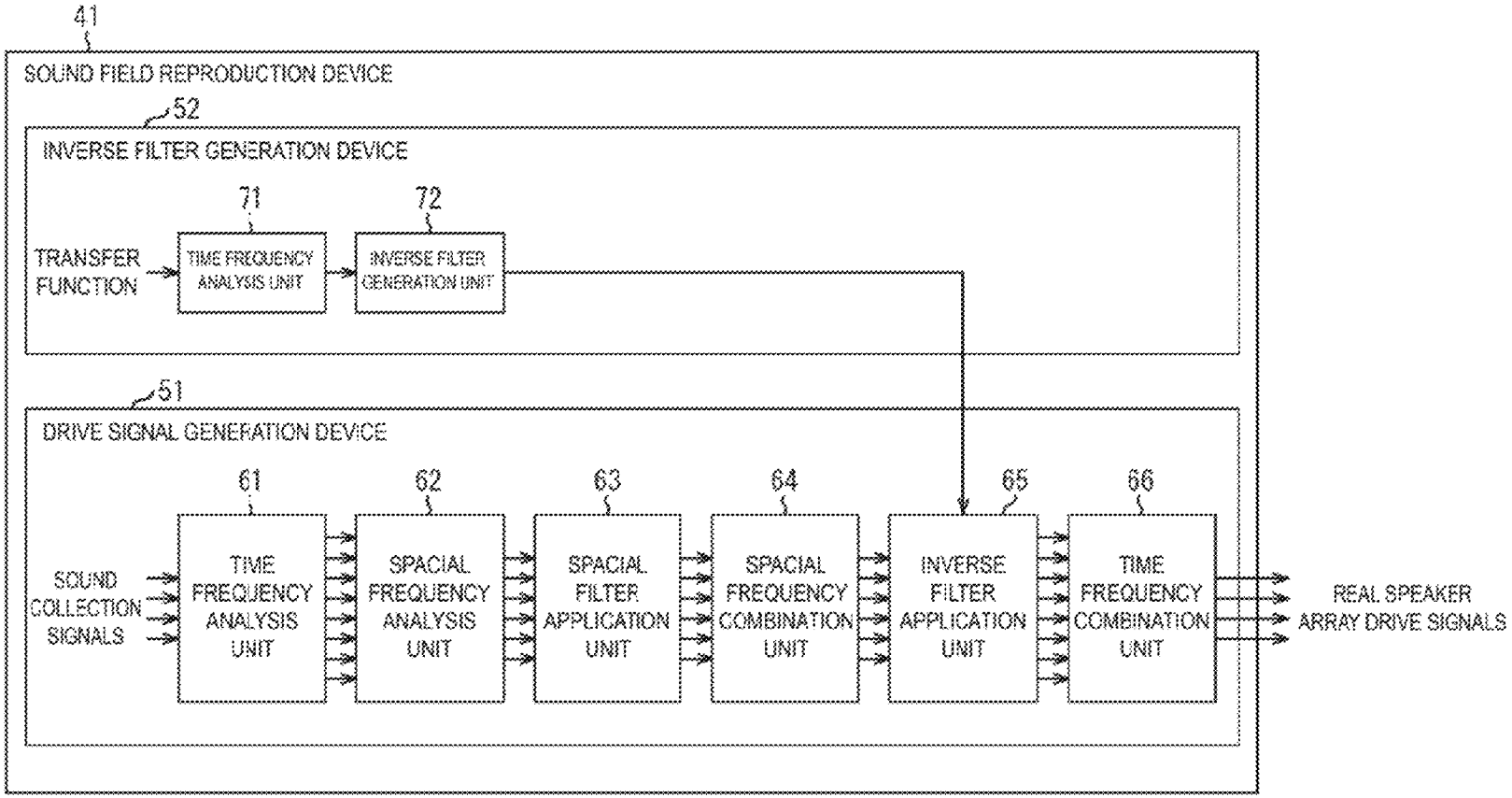
FIG. 5 is a figure that shows a configuration example of a sound field reproduction device.

FIG. 5 is a figure that shows a configuration example of an embodiment of a sound field reproduction device to which the present technology is applied.

A sound field reproduction device 41 has a drive signal generation device 51 and an inverse filter generation device 52.

The drive signal generation device 51 applies a filter process using an inverse filter obtained by the inverse filter generation device 52 to a sound collection signal obtained by collecting sounds by each of the microphones constituting the spherical microphone array 11, that is, microphone sensors, supplies a real speaker array drive signal obtained as a result of this to the real speaker array 12, and causes the real speaker array 12 to output a voice. That is, a real speaker array drive signal for actually performing sound field reproduction is generated, by using an inverse filter generated by the inverse filter generation device 52.

The inverse filter generation device 52 generates an inverse filter based on input transfer functions, and supplies it to the drive signal generation device 51.

Here, the transfer functions input to the inverse filter generation device 52 are assumed to be impulse responses from each of the speakers constituting the real speaker array 12 shown in FIG. 3, for example, up to each of the speaker positions constituting the virtual speaker array 13.

The drive signal generation device 51 has a time frequency analysis unit 61, a spacial frequency analysis unit 62, a spacial filter application unit 63, a spacial frequency combination unit 64, an inverse filter application unit 65, and a time frequency combination unit 66.

Further, the inverse filter generation device 52 has a time frequency analysis unit 71 and an inverse filter generation unit 72.

Hereinafter, each of the units constituting the drive signal generation device 51 and the inverse filter generation device 52 will be described in detail.

(Time Frequency Analysis Unit)

The time frequency analysis unit 61 analyzes time frequency information of a sound collection signal s(p,t) at a position $O_{mic}(p)=[a_p \cos\theta_p \cos\varphi_p, a_p \sin\theta_p \cos\varphi_p, a_p \sin\varphi_p]$ of each of the microphone sensors of the spherical microphone array 11 set so that the center matches a reference point of a real space.

However, at the position $O_{mic}(p)$, $a_p$ shows a sensor radius, that is, a distance from a center position of the spherical microphone array 11 up to each of the microphone sensors (microphones) constituting this spherical microphone array 11, $\theta_p$ shows a sensor azimuth angle, and $\varphi_p$ shows a sensor elevation angle. The sensor azimuth angle $\theta_p$ and the sensor elevation angle $\varphi_p$ are an azimuth angle and an elevation angle of each of the microphone sensors viewed from the center of the spherical microphone array 11. Therefore, the position p (position $O_{mic}(p)$) shows a position of each of the microphone sensors of the spherical microphone array 11 expressed by polar coordinates.

Note that, hereinafter, the sensor radius $a_p$ will also be simply described as a sensor radius a. Further, in this embodiment, while a spherical microphone array 11 is used, an annular microphone array, for which only a sound field of a horizontal surface is able to be collected, may also be used.

First, the time frequency analysis unit 61 obtains an input frame signal $s_{fr}(p,n,l)$, to which a time frame division of a fixed size is performed, from a sound collection signal s(p,t). Then, the time frequency analysis unit 61 multiplies a window function $w_{ana}(n)$ shown in Formula (1) by the input frame signal $s_{fr}(p,n,l)$, and obtains a window function application signal $s_w(p,n,l)$. That is, a window function application signal $s_w(p,n,l)$ is calculated, by performing the following calculation of Formula (2).

[Math. 1]

$$w_{ana}(n) = \left(0.5 - 0.5\cos\left(2\pi\frac{n}{N_{fr}}\right)\right)^{0.5} \tag{1}$$

[Math. 2]

$$s_w(p, n, l) = w_{ana}(n)s_{fr}(p, n, l) \tag{2}$$

Here, in Formula (1) and Formula (2), n shows a time index, and is a time index n=0, . . . , $N_{fr}-1$. Further, 1 shows a time frame index, and is a time frame index 1=0, . . . , L−1. Note that, $N_{fr}$ is a frame size (a sample number of a time frame), and L is a total frame number.

Further, the frame size $N_{fr}$ is a sample number $N_{fr}$ (=R (fs×fsec), however, R( ) is an arbitrary rounding function) corresponding to a time fsec of one frame in a sampling frequency fs. In this embodiment, for example, while the rounding function R( ) which is a time fsec of one frame=0.02[s], is rounded off, it may be other than this. In addition, while a shift amount of a frame is set to 50% of the frame size $N_{fr}$, it may be other than this.

In addition, here, while a square root of a Hanning window is used as a window function, a window other than this, such as a Hamming window or a Blackman-Harris window, may be used.

In this way, when a window function application signal $s_w(p,n,l)$ is obtained, the time frequency analysis unit 61 performs a time frequency conversion for a window function application signal $s_w(p,n,l)$, by calculating the following Formula (3) and Formula (4), and obtains a time frequency spectrum S(p,ω,l).

[Math. 3]

$$s'_w(p, q, l) = \begin{cases} s_w(p, q, l) & q = 0, \ldots, N-1 \\ 0 & q = N, \ldots, Q-1 \end{cases} \tag{3}$$

[Math. 4]

$$S(p, \omega, l) = \sum_{q=0}^{Q-1} s'_w(p, q, l)\exp\left(-i2\pi\frac{q\omega}{Q}\right) \tag{4}$$

That is, a zero-padded signal $s_w'(p,q,l)$ is obtained by the calculation of Formula (3), Formula (4) is calculated based on the obtained zero-padded signal $s_w'(p,q,l)$, and a time frequency spectrum S(p,ω,l) is calculated.

Note that, in Formula (3) and Formula (4), Q shows a point number used for the time frequency conversion, and i in Formula (4) shows a pure imaginary number. Further, w shows a time frequency index. Here, when setting Ω=Q/2+1, ω=0, . . . , Ω−1.

Therefore, a time frequency spectrum S(p,ω,l) of LxΩ is obtained, for each sound collection signal output from each of the microphones of the spherical microphone array 11.

Further, in this embodiment, while a time frequency conversion is performed by a Discrete Fourier Transform (DFT) (Discrete Fourier Transform), another time frequency conversion, such as a Discrete Cosine Transform (DCT) (Discrete Cosine Transform) or a Modified Discrete Cosine Transform (MDCT) (Modified Discrete Cosine Transform), may be used.

In addition, while a point number Q of a DFT is set to a value of an exponent of 2 nearest to $N_{fr}$, which is $N_{fr}$ or more, it may be a point number Q other than this.

The time frequency analysis unit 61 supplies the time frequency spectrum S(p,ω,l) obtained by the above described process to the spacial frequency analysis unit 62.

Further, the time frequency analysis unit 71 of the inverse filter generation device 52 also supplies the obtained time frequency spectrum to the inverse filter generation unit 72, by performing a process similar to that of the time frequency analysis unit 61 for transfer functions from the speakers of the real speaker array 12 up to the speakers of the virtual speaker array 13.

(Spacial Frequency Analysis Unit)

To continue, the spacial frequency analysis unit 62 analyses spacial frequency information of the time frequency spectrum S(p,ω,l) supplied from the time frequency analysis unit 61.

For example, the spacial frequency analysis unit 62 performs a spacial frequency conversion by a spherical surface harmonic function $Y_n^{-m}(\theta,\varphi)$, by calculating Formula (5), and obtains a spacial frequency spectrum $S_n^m(a,\omega,l)$. However, N is the degree of the spherical surface harmonic function, and is n=0, . . . , N.

[Math. 5]

$$s_n^m(a, \omega, l) = \sum_{p=1}^{P} S(p, \omega, l)Y_n^{-m}(\theta_p, \phi_p) \tag{5}$$

$$m = -n, \ldots, n$$

Note that, in Formula (5), P shows a sensor number of the spherical microphone array 11, that is, the number of microphone sensors, and n shows the degree. Further, $\theta_p$ shows a sensor azimuth angle, $\varphi_p$ shows a sensor elevation angle, and a shows a sensor radius of the spherical microphone array 11. ω shows a time frequency index, and 1 shows a time frame index.

In addition, the spherical surface harmonic function $Y_n^m(\theta,\varphi)$ is given by an associated Legendre polynomial $P_n^m(z)$, such as shown in Formula (6). The maximum degree N of the spherical surface harmonic function is limited by the sensor number P, and is N=(P+1)2.

[Math. 6]

$$Y_n^m(\theta,\phi) = (-1)^m \sqrt{\frac{(2n+1)(n+|m|)!}{4\pi(n+|m|)!}}\, P_n^{|m|}(\cos\phi)e^{im\theta} \tag{6}$$

Such an obtained spacial frequency spectrum $S_n^m(a,\omega,l)$ shows what shape the signal of a time frequency ω included in a time frame 1 becomes in a space, and a spacial frequency spectrum of ΩxP is obtained for each time frame 1.

The spacial frequency analysis unit 62 supplies the spacial frequency spectrum $S_n^m(a,\omega,l)$ obtained by the above described process to the spacial filter application unit 63.

(Spacial Filter Application Unit)

The spacial filter application unit 63 converts the spacial frequency spectrum into a virtual speaker array drive signal of the annular virtual speaker array 13 with a radius r larger than a sensor radius a of the spherical microphone array 11, by applying a spacial filter $w_n(a,r,\omega)$ to the spacial frequency spectrum $S_n^m(a,\omega,l)$ supplied from the spacial frequency analysis unit 62. That is, the spacial frequency spectrum $S_n^m(a,\omega,l)$ is converted into a virtual speaker array drive signal, that is, a spacial frequency spectrum $D_n^m(r,\omega,l)$, by calculating Formula (7).

[Math. 7]

$$D_n^m(r,\omega,l)=w_n(a,r,\omega)S_n^m(a,\omega,l) \tag{7}$$

Note that, the spacial filter $w_n(a,r,\omega)$ in Formula (7) is set, for example, to the filter shown in Formula (8).

[Math. 8]

$$w_n(a,r,\omega) = \frac{1}{2i^n B_n(ka)R_n(kr)} \tag{8}$$

In addition, $B_n(ka)$ and $R_n(kr)$ in Formula (8) are respectively set to the functions shown in Formula (9) and Formula (10).

[Math. 9]

$$B_n(ka) = J_n(ka) - \frac{J_n'(ka)}{H_n'(ka)}H_n(ka) \tag{9}$$

[Math. 10]

$$R_n(kr)=-ikre^{ikr}i^{-n}H_n(kr) \tag{10}$$

Note that, in Formula (9) and Formula (10), $J_n$ and $H_n$ respectively show a spherical Bessel function and a first-kind spherical surface Hankel function. Further, $J_n'$ and $H_n'$ respectively show differentiation values of $J_n$ and $H_n$.

In this way, a sound collection signal obtained by collecting sounds by the spherical microphone array 11 can be converted to a virtual speaker array drive signal, for which a sound field is reproduced, at the time when regenerated by the virtual speaker array 13, by applying a filter process using a spacial filter to a spacial frequency spectrum.

In this way, since a process that converts a sound collection signal to a virtual speaker array drive signal is not able to be performed in a time frequency region, the sound field reproduction device 41 converts a sound collection signal into a spacial frequency spectrum, and applies a spacial filter.

The spacial filter application unit 63 supplies such an obtained spacial frequency spectrum $D_n^m(r,\omega,l)$ to the spacial frequency combination unit 64.

(Spacial Frequency Combination Unit)

The spacial frequency combination unit 64 performs a spacial frequency combination of the spacial frequency spectrum $D_n^m(r,\omega,l)$ supplied from the spacial filter application unit 63, by performing the calculation of Formula (11), and obtains a time frequency spectrum $D_t(x_{vspk},\omega,l)$.

[Math. 11]

$$D_t(x_{vspk},\omega,l) = \sum_{n}^{N}\sum_{m=-n}^{n} D_n^m(r,\omega,l)Y_n^m(\theta_p,\phi_p) \tag{11}$$

Note that, in Formula (11), N shows the degree of the spherical surface harmonic function $Y_n^m(\theta_p,\varphi_p)$, and n shows the degree. Further, $\theta_p$ shows a sensor azimuth angle, $\varphi_p$ shows a sensor elevation angle, and r shows a radius of the virtual speaker array 13. ω shows a time frequency index, and $x_{vspk}$ is an index that shows the speakers constituting the virtual speaker array 13.

In the spacial frequency combination unit 64, a time frequency spectrum $D_t(x_{vspk},\omega,l)$ of Ω, which is the number of time frequencies for each time frame 1, is obtained for each of the speakers constituting the virtual speaker array 13.

The spacial frequency combination unit 64 supplies such an obtained time frequency spectrum $D_t(x_{vspk},\omega,l)$ to the inverse filter application unit 65.

(Inverse Filter Generation Unit)

Further, the inverse filter generation unit 72 of the inverse filter generation device 52 obtains an inverse filter $H(x_{vspk}, x_{rspk},\omega)$ based on the time frequency spectrum $S(x,\omega,l)$ supplied from the time frequency analysis unit 71.

The time frequency spectrum $S(x,\omega,l)$ is the result of having a transfer function $g(x_{vspk},x_{rspk},n)$ from the real speaker array 12 up to the virtual speaker array 13 time frequency analyzed, and here, is described as $G(x_{vspk},x_{rspk},\omega)$ in order to distinguish from the time frequency spectrum $S(p,\omega,l)$ obtained by the time frequency analysis unit 61 of the lower stage of FIG. 5.

Note that, $x_{vspk}$ in the transfer function $g(x_{vspk},x_{rspk},n)$, the time frequency spectrum $G(x_{vspk},x_{rspk},\omega)$, and the inverse filter $H(x_{vspk},x_{rspk},\omega)$ is an index that shows the speakers constituting the virtual speaker array 13, and $x_{rspk}$ is an index that shows the speakers constituting the real speaker array 12. Further, n shows a time index, and ω shows a time frequency index. Note that, in the time frequency spectrum $G(x_{vspk},x_{rspk},\omega)$, the time frame index 1 is omitted.

The transfer function $g(x_{vspk},x_{rspk},n)$ is measured beforehand by placing microphones (microphone sensors) at the positions of each of the speakers of the virtual speaker array 13.

For example, the inverse filter generation unit 72 obtains an inverse filter $H(x_{vspk},x_{rspk},\omega)$ from the virtual speaker array 13 up to the real speaker array 12 by obtaining an inverse filter from a measurement result. That is, an inverse filter $H(x_{vspk},x_{rspk},\omega)$ is calculated, by the calculation of Formula (12).

[Math. 12]

$$H=G^{-1} \tag{12}$$

Note that, in Formula (12), H and G respectively represent the inverse filter $H(x_{vspk},x_{rspk},\omega)$ and the time frequency spectrum $G(x_{vspk},x_{rspk},\omega)$ (transfer function $g(x_{vspk},x_{rspk},n)$) by matrices, and $(.)^{-1}$ shows a pseudo inverse matrix. Generally, a stable solution is not able to be obtained in the case where the rank of a matrix is low.

That is, when the radius r of the virtual speaker array 13 is small, that is, when the distances from a center position (reference position) of the virtual speaker array 13 up to the speakers of the virtual speaker array 13 are short, the variations of characteristics of each transfer function $g(x_{vspk},x_{rspk},n)$ will become small. Then, the rank of a matrix will become low, and a stable solution will not be able to be obtained. Accordingly, a radius r of a spherical or annular virtual speaker capable of obtaining a stable solution is obtained beforehand.

At this time, in order to be able to obtain a stable solution, that is, in order to be able to obtain an accurate inverse filter $H(x_{vspk},x_{rspk},\omega)$, at least a radius r of the virtual speaker array 13 is determined so as to become a value larger than a sensor radius a of the spherical microphone array 11.

If an inverse filter $H(x_{vspk},x_{rspk},\omega)$ is obtained from the transfer function $g(x_{vspk},x_{rspk},n)$, a virtual speaker array drive signal for reproducing a sound field by the virtual speaker array 13 can be converted to a real speaker array drive signal of the real speaker array 12 with an arbitrary shape, by a filter process using the inverse filter.

The inverse filter generation unit 72 supplies such an obtained inverse filter $H(x_{vspk},x_{rspk},\omega)$ to the inverse filter application unit 65.

(Inverse Filter Application Unit)

The inverse filter application unit 65 applies the inverse filter $H(x_{vspk},x_{rspk},\omega)$ supplied from the inverse filter generation unit 72 to the time frequency spectrum $D_t(x_{vspk},\omega,l)$ supplied from the spacial frequency combination unit 64, and obtains an inverse filter signal $D_i(x_{rspk},\omega,l)$. That is, the inverse filter application unit 65 calculates an inverse filter signal $D_i(x_{rspk},\omega,l)$ by a filter process, by performing the calculation of Formula (13). This inverse filter signal is a time frequency spectrum of a real speaker array drive signal for reproducing a sound field. In the inverse filter application unit 65, an inverse filter signal $D_i(x_{rspk},\omega,l)$ of Ω, which is the number of time frequencies for each time frame 1, is obtained for each of the speakers constituting the real speaker array 12.

[Math. 13]

$$D_i(x_{rspk},\omega,l)=H(x_{vspk},x_{rspk},\omega)D_t(x_{vspk},\omega,l) \tag{13}$$

The inverse filter application unit 65 supplies such an obtained inverse filter signal $D_i(x_{rspk},\omega,l)$ to the time frequency combination unit 66.

(Time Frequency Combination Unit)

The time frequency combination unit 66 performs a time frequency combination of the inverse filter signal $D_i(x_{rspk},\omega,l)$ supplied from the inverse filter application unit 65, that is, a time frequency spectrum, by performing the calculation of Formula (14), and obtains an output frame signal $d'(x_{rspk},n,l)$.

[Math. 14]

$$d'(x_{rspk},n,l)=\frac{1}{Q}\sum_{\omega=0}^{Q-1}D'(x_{rspk},\omega,l)\exp\left(i2\pi\frac{n\omega}{Q}\right) \tag{14}$$

Note that, $D'(x_{rspk},\omega,l)$ in Formula (14) is obtained by formula (15).

[Math. 15]

$$D'(x_{rspk},\omega,l)=\begin{cases} D_i(x_{rspk},\omega,l) & \omega=0,\ldots,\frac{Q}{2} \\ \mathrm{conj}(D_i(x_{rspk},Q-\omega,l)) & \omega=\frac{Q}{2}+1,\ldots,Q-1 \end{cases} \tag{15}$$

Further, here, while an example is described that uses an Inverse Discrete Fourier Transform (IDFT) (Inverse Discrete Fourier Transform), it may use that corresponding to an inverse conversion of the conversion used by the time frequency analysis unit 61.

In addition, the time frequency combination unit 66 multiplies a window function $w_{syn}(n)$ by the obtained output frame signal $d'(x_{rspk},n,l)$, and performs a frame combination by performing an overlap addition. For example, an output signal $d(x_{rspk},t)$ is obtained, by using the window function $w_{syn}(n)$ shown in Formula (16), and performing a frame combination by the calculation of Formula (17).

[Math. 16]

$$w_{syn}(n)=\begin{cases} \left(0.5-0.5\cos\left(2\pi\frac{n}{N}\right)\right)^{0.5} & n=0,\ldots,N-1 \\ 0 & n=N,\ldots,Q-1 \end{cases} \tag{16}$$

[Math. 17]

$$d^{curr}(x_{rspk},n+lN)=d'(x_{rspk},n,l)w_{syn}(n)+d^{prev}(x_{rspk},n+lN) \tag{17}$$

Note that, here, while it uses that the same as the window function used by the time frequency analysis unit 61, it may be a rectangular window in the case of a window other than this, such as a Hamming window.

Further, in Formula (17), while both $d^{prev}(x_{rspk},n+lN)$ and $d^{curr}(x_{rspk},n+lN)$ show an output signal $d(x_{rspk},t)$, $d^{prev}(x_{rspk},n+lN)$ shows a value prior to updating, and $d^{curr}(x_{rspk},n+lN)$ shows a value after updating.

The time frequency combination unit 66 sets such an obtained output signal $d(x_{rspk},t)$ to an output of the sound field reproduction device 41 as a real speaker array drive signal.

As described above, a sound field can be more accurately reproduced, by the sound field reproduction device 41.

<Description of the Real Speaker Array Drive Signal Generation Process>

Next, the flow of the processes performed by the above described sound field reproduction device 41 will be described. When a transfer function and a sound collection signal are supplied, the sound field reproduction device 41 performs a real speaker array drive signal generation process that performs an output by converting the sound collection signal to a real speaker array drive signal.

Hereinafter, the real speaker array drive signal generation process by the sound field reproduction device 41 will be described by referring to the flow chart of FIG. 6. Note that, while the generation of an inverse filter may be performed beforehand by the inverse filter generation device 52, here, a description will be continued as having an inverse filter generated at the time of the generation of a real speaker array drive signal.

In step S11, the time frequency analysis unit 61 analyzes time frequency information of a sound collection signal s(p,t) supplied from the spherical microphone array 11.

Specifically, the time frequency analysis unit 61 performs a time frame division for a sound collection signal s(p,t), multiplies a window function $w_{ana}(n)$ by an input frame signal $s_{fr}(p,n,l)$ obtained as a result of this, and calculates a window function application signal $s_w(p,n,l)$.

Further, the time frequency analysis unit 61 performs a time frequency conversion for the window function application signal $s_w(p,n,l)$, and supplies a time frequency spectrum $S(p,\omega,l)$ obtained as a result of this to the spacial frequency analysis unit 62. That is, a time frequency spectrum $S(p,\omega,l)$ is calculated by performing the calculation of Formula (4).

In step S12, the spacial frequency analysis unit 62 performs a spacial frequency conversion for the time frequency spectrum $S(p,\omega,l)$ supplied from the time frequency analysis unit 61, and supplies a spacial frequency spectrum $S_n^m(a,\omega,l)$ obtained as a result of this to the spacial filter application unit 63.

Specifically, the spacial frequency analysis unit 62 converts the time frequency spectrum $S(p,\omega,l)$ into a spacial frequency spectrum $S_n^m(a,\omega,l)$, by calculating Formula (5).

In step S13, the spacial filter application unit 63 applies a spacial filter $w_n(a,r,\omega)$ to the spacial frequency spectrum $S_n^m(a,\omega,l)$ supplied from the spacial frequency analysis unit 62.

That is, the spacial filter application unit 63 applies a filter process using a spacial filter $w_n(a,r,\omega)$ to the spacial frequency spectrum $S_n^m(a,\omega,l)$, by calculating Formula (7), and supplies a spacial frequency spectrum $D_n^m(r,\omega,l)$ obtained as a result of this to the spacial frequency combination unit 64.

In step S14, the spacial frequency combination unit 64 performs a spacial frequency combination of the spacial frequency spectrum $S_n^m(r,\omega,l)$ supplied from the spacial filter application unit 63, and supplies a time frequency spectrum $D_t(x_{vspk},\omega,l)$ obtained as a result of this to the inverse filter application unit 65. That is, in step S14, a time frequency spectrum $D_t(x_{vspk},\omega,l)$ is obtained, by performing the calculation of Formula (11).

In step S15, the time frequency analysis unit 71 analyzes time frequency information of a supplied transfer function $g(x_{vspk},x_{rspk},n)$. Specifically, the time frequency analysis unit 71 performs a process similar to the process in step S11 for a transfer function $g(x_{vspk},x_{rspk},n)$, and supplies a time frequency spectrum $G(x_{vspk},x_{rspk},\omega)$ obtained as a result of this to the inverse filter generation unit 72.

In step S16, the inverse filter generation unit 72 calculates an inverse filter $H(x_{vspk},x_{rspk},\omega)$ based on the time frequency spectrum $G(x_{vspk},x_{rspk},\omega)$ supplied from the time frequency analysis unit 71, and supplies it to the inverse filter application unit 65. For example, in step S16, the calculation of Formula (12) is performed, and an inverse filter $H(x_{vspk},x_{rspk},\omega)$ is calculated.

In step S17, the inverse filter application unit 65 applies the inverse filter $H(x_{vspk},x_{rspk},\omega)$ supplied from the inverse filter generation unit 72 to the time frequency spectrum $D_t(x_{vspk},\omega,l)$ supplied from the spacial frequency combination unit 64, and supplies an inverse filter signal $D_i(x_{rspk},\omega,l)$ obtained as a result of this to the time frequency combination unit 66. For example, in step S17, the calculation of Formula (13) is performed, and an inverse filter signal $D_i(x_{rspk},\omega,l)$ is calculated by a filter process.

In step S18, the time frequency combination unit 66 performs a time frequency combination of the inverse filter $D_i(x_{rspk},\omega,l)$ supplied from the inverse filter application unit 65.

Specifically, the time frequency combination unit 66 calculates an output frame signal $d'(x_{rspk},n,l)$ from the inverse filter signal $D_i(x_{rspk},\omega,l)$, by performing the calculation of Formula (14). In addition, the time frequency combination unit 66 performs the calculation of Formula (17) by multiplying a window function $w_{syn}(n)$ by the output frame signal $d'(x_{rspk},n,l)$, and calculates an output signal $d(x_{rspk},t)$ by a frame combination. The time frequency combination unit 66 outputs such an obtained output signal $d(x_{rspk},t)$ to the real speaker array 12 as a real speaker array drive signal, and the real speaker array drive signal generation process ends.

As described above, the sound field reproduction device 41 generates a virtual speaker array drive signal from a sound collection signal, by a filter process using a spacial filter, and additionally generates a real speaker array drive signal by a filter process using an inverse filter for the virtual speaker array drive signal.

In the sound field reproduction device 41, a sound field can be more accurately reproduced, even if the shape of the real speaker array 12 is some shape, by generating a virtual speaker array drive signal of the virtual speaker array 13 with a radius r larger than a sensor radius a of the spherical microphone array 11, and converting the obtained virtual speaker array drive signal into a real speaker array drive signal using an inverse filter.

Second Embodiment

Configuration Example of the Sound Field Reproduction System

Note that, heretofore, while an example has been described where one apparatus executes a process that converts a sound collection signal to a real speaker array drive signal, a process that converts a sound collection signal to a real speaker array drive signal may be performed, by a sound field reproduction system constituted from several apparatuses.

Figure 7:
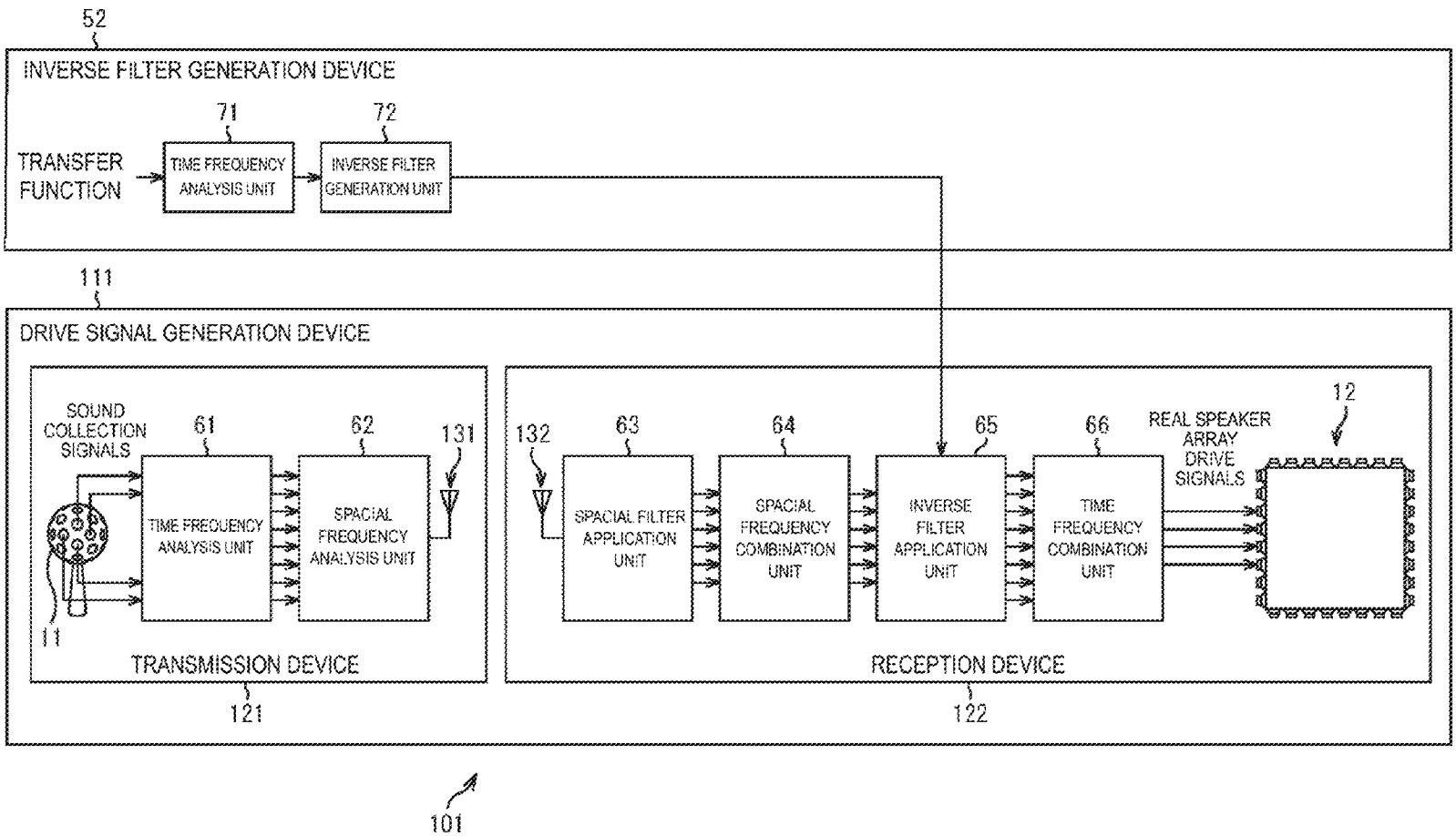
FIG. 7 is a figure that shows a configuration example of a sound field reproduction system.

Such a sound field reproduction system is, for example, constituted such as shown in FIG. 7. Note that, in FIG. 7, the same reference numerals are attached to the portions corresponding to the case in FIG. 3 or FIG. 5, and a description of these will be omitted.

The sound field reproduction system 101 shown in FIG. 7 is constituted from a drive signal generation device 111 and an inverse filter generation device 52. Similar to the case in FIG. 5, a time frequency analysis unit 71 and an inverse filter generation unit 72 are included in the inverse filter generation device 52.

Further, the drive signal generation device 111 is constituted from a transmission device 121 and a reception device 122 that perform a transfer of various types of information or the like by mutually performing communication wirelessly. In particular, the transmission device 121 is arranged in a real space where a sound collection of spherical waves (a voice) is performed, and the reception device 122 is arranged in a reproduction space that regenerates the collected voice.

The transmission device 121 has a spherical microphone array 11, a time frequency analysis unit 61, a spacial frequency analysis unit 62, and a communication unit 131. The communication unit 131 is constituted from an antenna or the like, and transmits a spacial frequency spectrum $S_n^m(a,\omega,l)$ supplied from the spacial frequency analysis unit 62 to the reception device 122 by wireless communication.

Further, the reception device 122 has a communication unit 132, a spacial filter application unit 63, a spacial frequency combination unit 64, an inverse filter application unit 65, a time frequency combination unit 66, and a real speaker array 12. The communication unit 132 is constituted from an antenna or the like, and performs a supply to the spacial filter application unit 63, by receiving the spacial frequency spectrum $S_n^m(a,\omega,l)$ transmitted from the communication unit 131 by wireless communication.

<Description of the Sound Field Reproduction Process>

Figure 8:
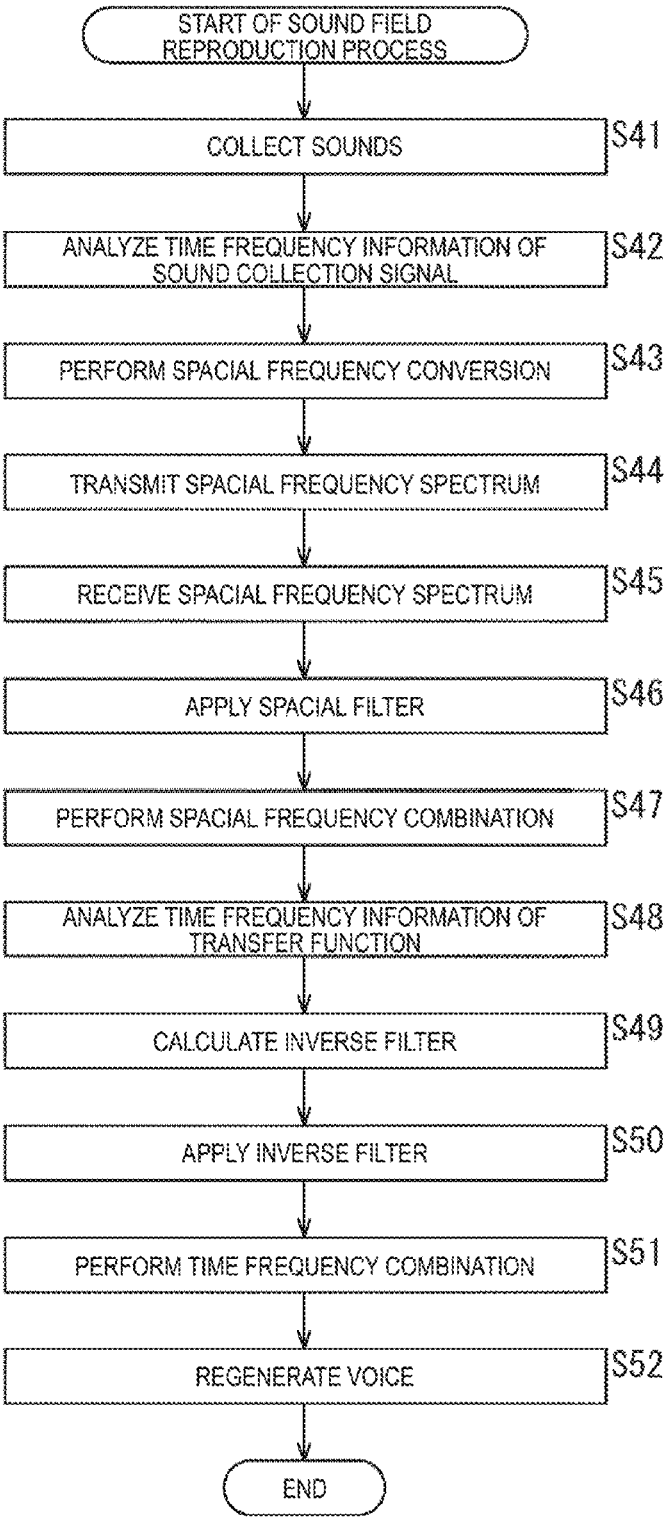
FIG. 8 is a flow chart that describes a sound field reproduction process.

Next, a sound field reproduction process performed by the sound field reproduction system 101 shown in FIG. 7 will be described by referring to the flow chart of FIG. 8.

In step S41, the spherical microphone array 11 collects a voice in a real space, and supplies a sound collection signal obtained as a result of this to the time frequency analysis unit 61.

Figure 6:
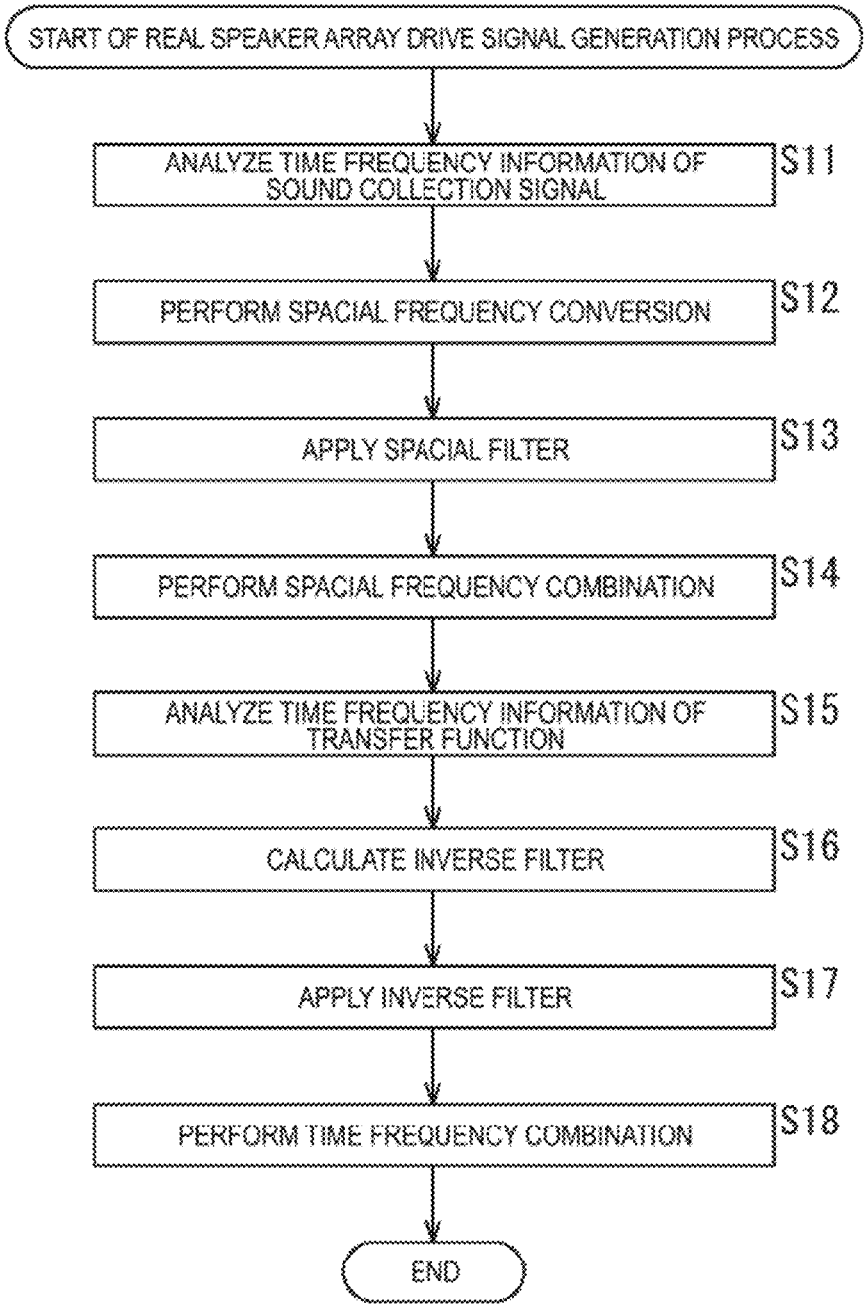
FIG. 6 is a flow chart that describes a real speaker array drive signal generation process.

While the processes of step S42 and step S43 are performed, afterwards, when the sound collection signal is obtained, these processes are similar to the processes of step S11 and step S12 of FIG. 6, and so a description of them will be omitted. However, in step S43, the spacial frequency analysis unit 62 supplies the obtained spacial frequency spectrum $S_n^m(a,\omega,l)$ to the communication unit 131.

In step S44, the communication unit 131 transmits the spacial frequency spectrum $S_n^m(a,\omega,l)$ supplied from the spacial frequency analysis unit 62 to the reception device 122 by wireless communication.

In step S45, the communication unit 132 performs a supply to the spacial filter application unit 63, by receiving the spacial frequency spectrum $S_n^m(a,\omega,l)$ transmitted from the communication unit 131 by wireless communication.

While the processes of step S46 through to step S51 are performed, afterwards, when the spacial frequency spectrum is received, these processes are similar to the processes of step S13 through to step S18 of FIG. 6, and so a description of them will be omitted. However, in step S51, the time frequency combination unit 66 supplies the obtained real speaker array drive signal to the real speaker array 12.

In step S52, the real speaker array 12 regenerates a voice based on the real speaker array drive signal supplied from the time frequency combination unit 66, and the sound field reproduction process ends. In this way, when a voice is regenerated based on a real speaker array drive signal, a sound field of a real space is reproduced in a reproduction space.

As described above, the sound field reproduction system 101 generates a virtual speaker array drive signal from a sound collection signal, by a filter process using a spacial filter, and additionally generates a real speaker array drive signal by a filter process using an inverse filter for the virtual speaker array drive signal.

At this time, a sound field can be more accurately reproduced, even if the shape of the real speaker array 12 is some shape, by generating a virtual speaker array drive signal of the virtual speaker array 13 with a radius r larger than a sensor radius a of the spherical microphone array 11, and converting the obtained virtual speaker array drive signal into a real speaker array drive signal by using an inverse filter.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose computer or the like that is capable of executing various functions when various programs are installed.

Figure 9:
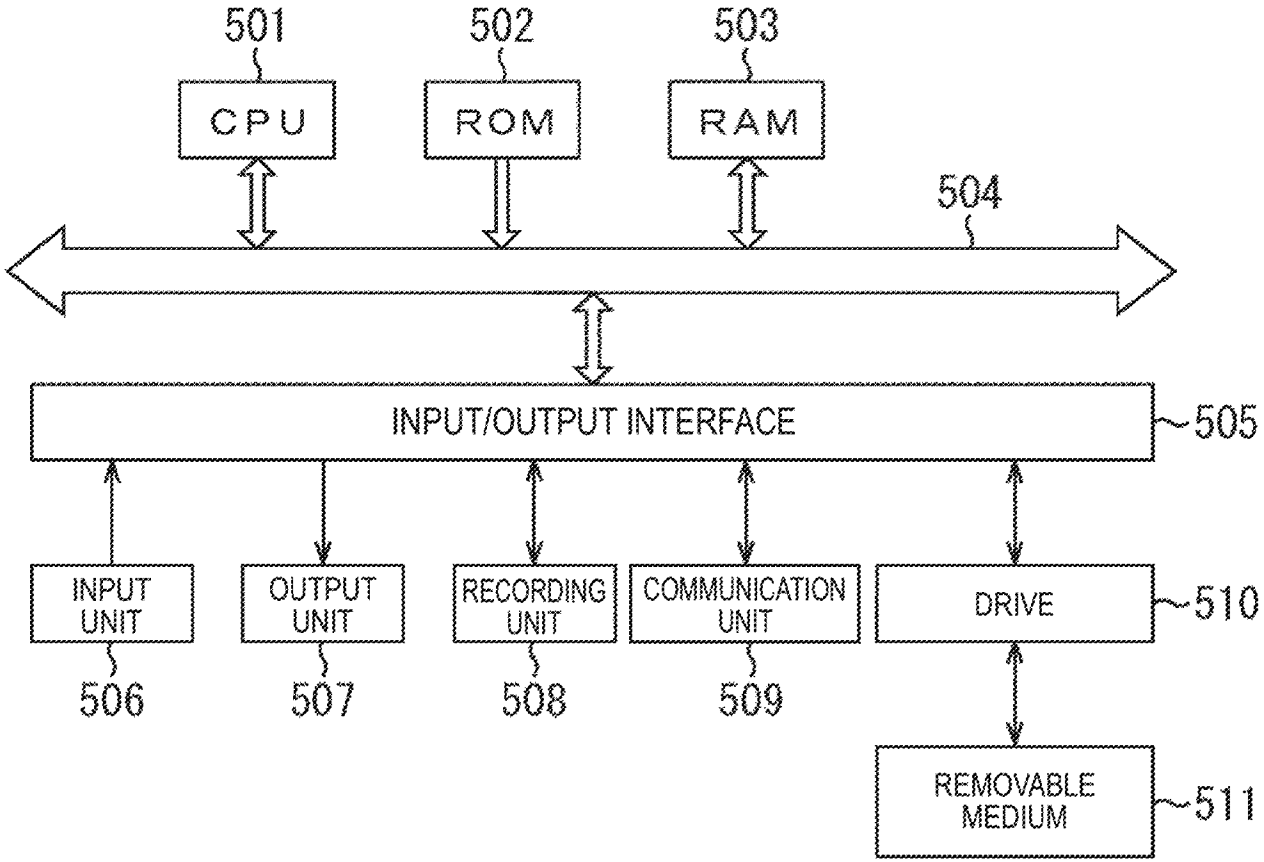
FIG. 9 is a figure that shows a configuration example of a computer.

FIG. 9 is a block diagram showing a hardware configuration example of a computer that performs the above-described series of processing using a program.

In the computer, a central processing unit (CPU) 501, a read only memory (ROM) 502 and a random access memory (RAM) 503 are mutually connected by a bus 504.

An input/output interface 505 is also connected to the bus 504. An input unit 506, an output unit 507, a recording unit 508, a communication unit 509, and a drive 510 are connected to the input/output interface 505.

The input unit 506 is configured from a keyboard, a mouse, a microphone, an imaging element or the like. The output unit 507 is configured from a display, a speaker or the like. The recording unit 508 is configured from a hard disk, a non-volatile memory or the like. The communication unit 509 is configured from a network interface or the like. The drive 510 drives a removable medium 511 such as a magnetic disk, an optical disk, a magneto-optical disk, a semiconductor memory or the like.

In the computer configured as described above, as one example the CPU 501 loads a program recorded in the recording unit 508 via the input/output interface 505 and the bus 504 into the RAM 503 and executes the program to carry out the series of processes described earlier.

Programs to be executed by the computer (the CPU 501) are provided being recorded in the removable medium 511 which is a packaged medium or the like. Also, programs may be provided via a wired or wireless transmission medium, such as a local area network, the Internet or digital satellite broadcasting.

In the computer, by loading the removable medium 511 into the drive 510, the program can be installed into the recording unit 508 via the input/output interface 505. It is also possible to receive the program from a wired or wireless transfer medium using the communication unit 509 and install the program into the recording unit 508. As another alternative, the program can be installed in advance into the ROM 502 or the recording unit 508.

It should be noted that the program executed by a computer may be a program that is processed in time series according to the sequence described in this specification or a program that is processed in parallel or at necessary timing such as upon calling.

An embodiment of the present technology is not limited to the embodiments described above, and various changes and modifications may be made without departing from the scope of the present technology.

For example, the present technology can adopt a configuration of cloud computing which processes by allocating and connecting one function by a plurality of apparatuses through a network.

Further, each step described by the above mentioned flow charts can be executed by one apparatus or by allocating a plurality of apparatuses.

In addition, in the case where a plurality of processes is included in one step, the plurality of processes included in this one step can be executed by one apparatus or by allocating a plurality of apparatuses.

Effects described in the present description are just examples, the effects are not limited, and there may be other effects.

Additionally, the present technology may also be configured as below.

(1)

A sound field reproduction apparatus, including:

a first drive signal generation unit configured to convert a sound collection signal obtained by having a spherical or annular microphone array collect sounds into a drive signal of a virtual speaker array having a second radius larger than a first radius of the microphone array; and a second drive signal generation unit configured to convert the drive signal of the virtual speaker array into a drive signal of a real speaker array arranged inside or outside a space surrounded by the virtual speaker array.

(2)

The sound field reproduction apparatus according to (1), wherein the first drive signal generation unit converts the sound collection signal into the drive signal of the virtual speaker array by applying a filter process using a spacial filter to a spacial frequency spectrum obtained from the sound collection signal.

(3)

The sound field reproduction apparatus according to (2), further including:

a spacial frequency analysis unit configured to convert a time frequency spectrum obtained from the sound collection signal into the spacial frequency spectrum.

(4)

The sound field reproduction apparatus according to any one of (1) to (3), wherein the second drive signal generation unit converts the drive signal of the virtual speaker array into the drive signal of the real speaker array by applying a filter process to the drive signal of the virtual speaker array by using an inverse filter based on a transfer function from the real speaker array up to the virtual speaker array.

(5)

The sound field reproduction apparatus according to any one of (1) to (4), wherein the virtual speaker array is a spherical or annular speaker array.

(6)

A sound field reproduction method, including:

a first drive signal generation step of converting a sound collection signal obtained by having a spherical or annular microphone array collect sounds into a drive signal of a virtual speaker array having a second radius larger than a first radius of the microphone array; and a second drive signal generation step of converting the drive signal of the virtual speaker array into a drive signal of a real speaker array arranged inside or outside a space surrounded by the virtual speaker array.

(7)

A program for causing a computer to execute a process including:

a first drive signal generation step of converting a sound collection signal obtained by having a spherical or annular microphone array collect sounds into a drive signal of a virtual speaker array having a second radius larger than a first radius of the microphone array; and a second drive signal generation step of converting the drive signal of the virtual speaker array into a drive signal of a real speaker array arranged inside or outside a space surrounded by the virtual speaker array.

REFERENCE SIGNS LIST

11 spherical microphone array
12 real speaker array
13 virtual speaker array
41 sound field reproduction device
51 drive signal generation device
52 inverse filter generation device
61 time frequency analysis unit
62 spacial frequency analysis unit
63 spacial filter application unit
64 spacial frequency combination unit
65 inverse filter application unit
66 time frequency combination unit
71 time frequency analysis unit
72 inverse filter generation unit
131 communication unit
132 communication unit

The invention claimed is:

1. A sound field reproduction apparatus, comprising:

a first drive signal generation unit configured to convert a sound collection signal, received from a spherical or annular microphone array, into a drive signal of a spherical or annular virtual speaker array by applying a spacial filter to a spacial frequency spectrum of the sound collection signal to obtain a spacial frequency spectrum of the drive signal of the virtual speaker array, the virtual speaker array having a second radius larger than a first radius of the microphone array; and a second drive signal generation unit configured to convert the drive signal of the virtual speaker array into a drive signal of a real speaker array arranged inside or outside a space surrounded by the virtual speaker array, wherein the second drive signal generation unit is configured to convert the drive signal of the virtual speaker array into the drive signal of the real speaker array by combining the spacial frequency spectrum of the drive signal of the virtual speaker array to obtain a time frequency spectrum, applying to the time frequency spectrum an inverse filter, based on a transfer function from the real speaker array up to the virtual speaker array, to obtain an inverse filter signal, and performing a time frequency combination of the inverse filter signal to obtain the drive signal of the real speaker array.

2. The sound field reproduction apparatus according to claim 1, further comprising:

a spacial frequency analysis unit configured to convert a time frequency spectrum obtained from the sound collection signal into the spacial frequency spectrum.

3. A sound field reproduction method, comprising:

a first drive signal generation step of converting a sound collection signal, received from a spherical or annular microphone array, into a drive signal of a spherical or annular virtual speaker array by applying a spacial filter to a spacial frequency spectrum of the sound collection signal to obtain a spacial frequency spectrum of the drive signal of the virtual speaker array, the virtual speaker array having a second radius larger than a first radius of the microphone array; and a second drive signal generation step of converting the drive signal of the virtual speaker array into a drive signal of a real speaker array arranged inside or outside a space surrounded by the virtual speaker array, wherein the second drive signal generation step converts the drive signal of the virtual speaker array into the drive signal of the real speaker array by combining the spacial frequency spectrum of the drive signal of the virtual speaker array to obtain a time frequency spectrum, applying to the time frequency spectrum an inverse filter, based on a transfer function from the real speaker array up to the virtual speaker array, to obtain an inverse filter signal, and performing a time frequency combination of the inverse filter signal to obtain the drive signal of the real speaker array.

4. A non-transitory computer-readable storage device encoded with instructions that, when executed by a computer, cause the computer to execute a process comprising:

a first drive signal generation step of converting a sound collection signal, received from a spherical or annular microphone array, into a drive signal of a spherical or annular virtual speaker array by applying a spacial filter to a spacial frequency spectrum of the sound collection signal to obtain a spacial frequency spectrum of the drive signal of the virtual speaker array, the virtual speaker array having a second radius larger than a first radius of the microphone array; and a second drive signal generation step of converting the drive signal of the virtual speaker array into a drive signal of a real speaker array arranged inside or outside a space surrounded by the virtual speaker array, wherein the second drive signal generation step converts the drive signal of the virtual speaker array into the drive signal of the real speaker array by combining the spacial frequency spectrum of the drive signal of the virtual speaker array to obtain a time frequency spectrum, applying to the time frequency spectrum an inverse filter, based on a transfer function from the real speaker array up to the virtual speaker array, to obtain an inverse filter signal, and performing a time frequency combination of the inverse filter signal to obtain the drive signal of the real speaker array.

* * * * *